US005302096A

United States Patent [19]

Cavalleri

[11] Patent Number: 5,302,096

[45] Date of Patent: Apr. 12, 1994

[54] HIGH PERFORMANCE DUAL CHAMBER ROTARY VANE COMPRESSOR

[76] Inventor: Robert J. Cavalleri, 1605 Gran Via, Orlando, Fla. 32825

[21] Appl. No.: 46,173

[22] Filed: Apr. 15, 1993

Related U.S. Application Data

[63] Continuation-in-part of Ser. No. 936,679, Aug. 28, 1992, abandoned.

[51] Int. Cl.[5] ..... F03C 2/00

[52] U.S. Cl. ..... 418/150; 418/261

[58] Field of Search ..... 418/150, 259, 260, 261

[56] References Cited

U.S. PATENT DOCUMENTS 4,515,514 5/1985 Hayase et al. ..... 418/150

4,799,867 1/1989 Sakamaki et al. ..... 418/261

4,802,830 2/1989 Nakajima et al. ..... 418/150

*Primary Examiner*—Richard A. Bertsch

*Assistant Examiner*—Charles G. Freay

*Attorney, Agent, or Firm*—H. Jay Spiegel

[57] ABSTRACT

A rotary vane compressor includes two stator chambers allowing two compression strokes for each revolution of the rotor. The shape of the chamber walls is specifically designed through the use of a sine function to increase efficiency of breathing of the compressor by providing a larger initial starting volume which reduces to a smaller discharge volume. The invention further includes a vane guiding mechanism preventing the rotor vanes from falling into the bottom of their respective slots to prevent slamming of the vanes upon start-up of the compressor.

8 Claims, 6 Drawing Sheets

HIGH PERFORMANCE DUAL CHAMBER ROTARY VANE COMPRESSOR

BACKGROUND OF THE INVENTION

This application is a continuation-in-part of application Ser. No. 07/936,679, filed Aug. 28, 1992 now abandoned.

The present invention relates to a high performance dual chamber rotary vane compressor. In the prior art, single chamber rotary vane compressors are known. Applicant is co-inventor of U.S. Pat. No. 4,521,167 for Low Frictional Loss Rotary Vane Gas Compressor Having Superior Lubrication Characteristics. Applicant is also patentee of U.S. Pat. No. 4,923,377 for Self-Machining Seal Ring Leakage Prevention Assembly For Rotary Vane Device. Each of these patents discloses a rotary vane compressor having a single chamber, thus providing only a single compression stroke per revolution of the rotor.

Additionally, Applicant is aware of U.S. Pat. No. 5,087,183 to Edwards, which patent teaches a single chamber rotary vane compressor as well. With the knowledge of these patents, Applicant has come to the conclusion that efficiency of such a compressor may be increased by combining plural compression strokes per rotor revolution with improvements in the shape of each chamber to maximize efficiency and to optimize compressor output. It is with these goals in mind that the present invention was developed.

SUMMARY OF THE INVENTION

The present invention relates to a high performance dual chamber rotary vane compressor. The present invention includes the following interrelated objects, aspects and features:

(A) In a first aspect, the inventive compressor includes a housing having two chambers whereby each revolution of the associated rotor results in two compression strokes.

(B) Each chamber has an outer surface which is engaged by vanes extendable from the rotor as the rotor rotates within the housing. These outer surfaces are shaped in accordance with a sine function specifically devised to enhance breathing of the compressor while increasing the starting volume to an optimal value and simultaneously decreasing the ending volume of the chamber to provide a high compression ratio.

(C) The sine function is modified by limiting the outward extent of the chamber surfaces to, at maximum, the extent of an elliptical curve such as found in prior art compressor chamber surfaces. The result is a surface having a shape wherein the diameter steeply increases to a maximum level, conforms to the elliptical shape for a distance and then steeply reduces in length to provide a high compression ratio, when compared to an elliptical housing.

(D) In a further aspect, an improvement is provided to prevent the rotor vanes from bottoming out within their guide slots within the rotor so that the vanes do not slam into the chamber surfaces upon start-up of the compressor. In this regard, each vane is provided with a vane guide pin which rides in a slot formed in the end plate of the compressor housing. The slot allows outward unrestricted reciprocatory travel of the vanes to a distance allowing firm engagement with the chamber surfaces at all times while precluding unrestricted inward reciprocation beyond a required degree.

As such, it is a first object of the present invention to provide a high performance dual chamber rotary vane compressor.

It is a further object of the present invention to provide such a compressor wherein each chamber is shaped to optimize compression ratio as well as breathability.

It is a yet further object of the present invention to provide such a compressor wherein the vanes of the rotor thereof carry vane guide pins which ride in a guide slot formed in the housing end plate.

It is a still further object of the present invention to provide such a device wherein the shape of the inlet and outlet ports is optimized as well.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
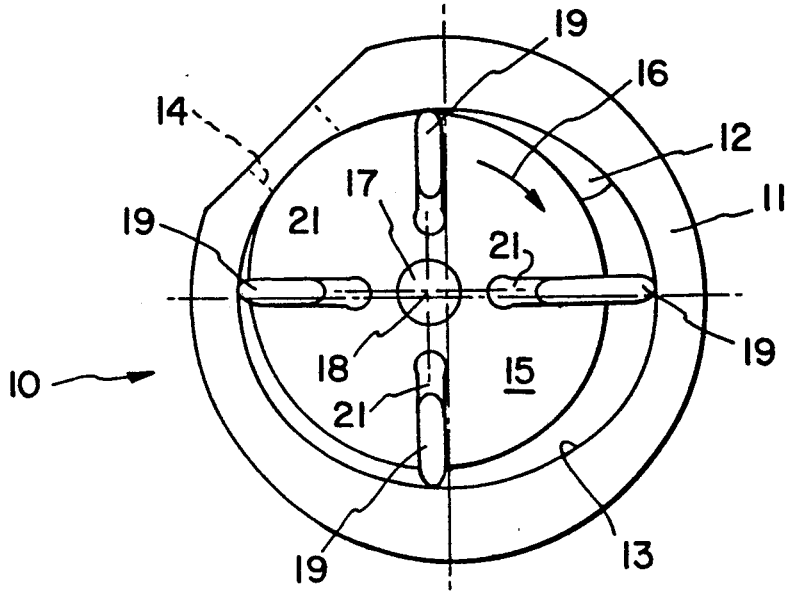
FIG. 1 PRIOR ART
FIG. 1 shows a side view of a single chamber per revolution compressor as known in the prior art.

With reference to FIG. 1, a standard rotary vane compressor has a single chamber per revolution for a set of vanes. As shown in FIG. 1, the single chamber per revolution compressor is generally designated by the reference numeral 10 and is seen to include a housing 11 having an internal chamber 13, a rotor 15 mounted within the chamber 13 for rotation on the axle 17 about the axis 18.

The rotor 15 carries vanes 19 which ride in respective slots 21 so that the tips of the vanes 19 are in contact with the wall of the chamber 13.

The housing 11 includes an inlet port 12 and a discharge port 14 with the rotor 15 rotating in the direction indicated by the arrow 16. In the operation of the device illustrated in FIG. 1, the rotor 15 rotates in the clockwise direction as indicated by the arrow 16 and the engagement of the vanes 19 on the outer walls of the chamber 13 causes air to be sucked into the chamber 13 via the inlet port 12, with the air being captured within the chamber boundaries formed between adjacent vanes 19, whereupon the particular location of the rotor 15 within the chamber 16 as illustrated in FIG. 1 causes the air to be compressed and thereafter discharged under pressure out the discharge port 14. The configuration of the chamber 13 of the compressor 10 illustrated in FIG. 1 is generally circular or slightly elliptical.

Figure 2:
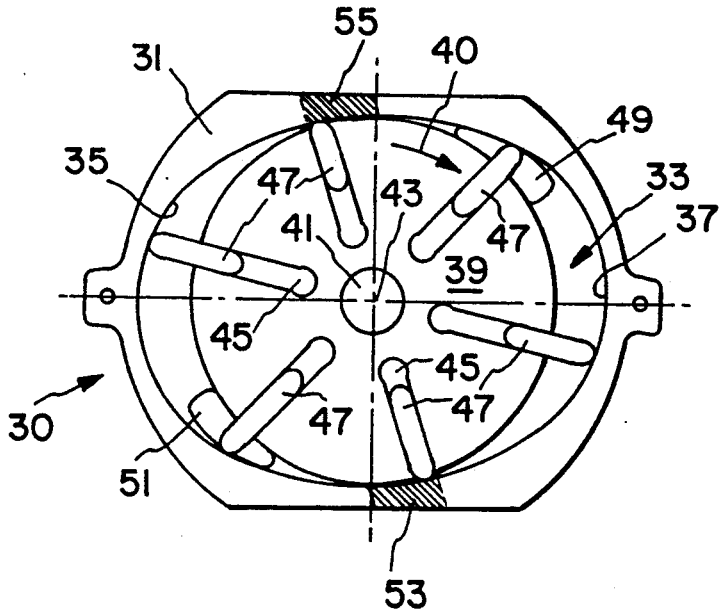
FIG. 2 shows a dual chamber per revolution compressor that improves upon the prior art.

The compressor 30 illustrated in FIG. 2 improves upon the teachings of the compressor 10 by providing two chambers whereupon a single revolution of the rotor results in two compression strokes.

The existence of two chambers in a single revolution results in a more energy efficient compressor. In the single chamber rotary compressor, the vane tip friction results in a friction penalty every time the rotor completes a single revolution. In the dual chamber rotary compressor, only half of the vane tip friction is required to compress the same amount of gas. Thus, with respect to vane tip friction, the friction loss is reduced to one half that for a single chamber rotary vane compressor. The friction losses due to the vane sliding in the rotor, however, would still be the same for either compressor.

With reference to FIG. 2, it is seen that the compressor 30 includes a housing 31 containing a chamber 33 including the housing chamber wall 35 and the housing chamber wall 37. The rotor 39 is centrally mounted in the housing 31 to rotate on the axle 41 about the axis 43. Recesses 45 reciprocably receive vanes 47 which are sized to allow continual engagement with the walls of the chamber 33 as the rotor 39 rotates in the clockwise direction as shown by the arrow 40.

The chamber 33 includes inlet ports 49 and 51 as well as discharge ports 53 and 55. As should be understood, from the view of FIG. 2, with the rotor 39 rotating in the clockwise direction, air is simultaneously sucked into the inlet ports 49 and 51, is captured in a chamber formed by the extension of adjacent vanes 47 within the housing walls 37 and 35 and is compressed and discharged under pressure out the discharge ports 53 and 55.

Figure 3:
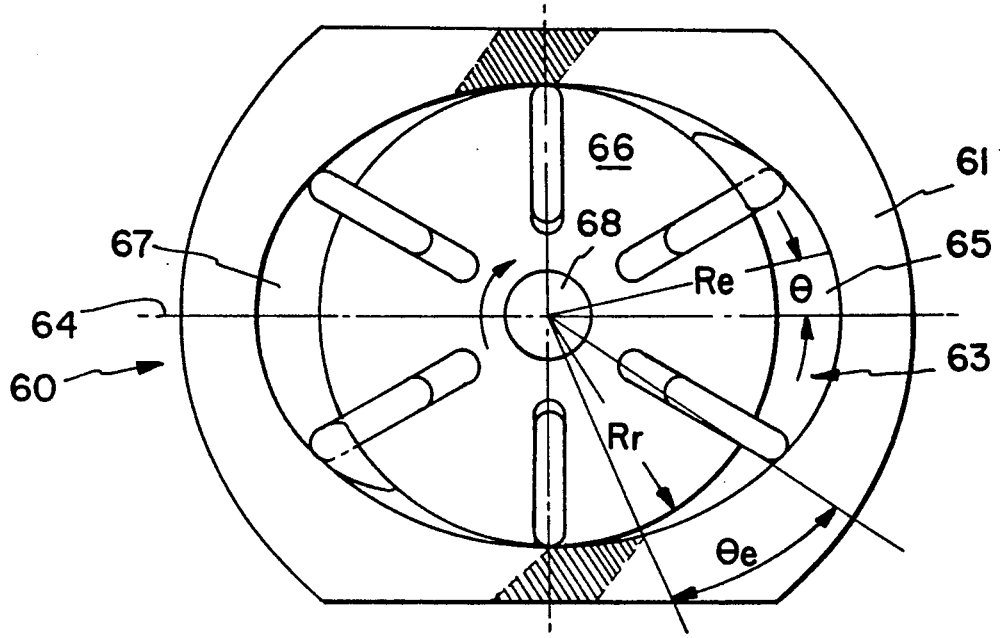
FIG. 3 shows a compressor having dual chambers with each chamber having an elliptical surface that clarifies the available discharge angle.

FIG. 3 shows a compressor which clarifies the available discharge angle ($\theta e$) of the compressor illustrated in FIG. 2. Thus, the compressor 60 includes a housing 61 having an internal chamber 63 consisting of two internal chambers 65 and 67 which have modified elliptical contours. A rotor 66 is rotatably mounted within the chamber 63 on the axle 68. The elliptical contour illustrated in FIG. 3 has been used in dual chamber compressors because of the widening of the elliptical shape along the horizontal axis. However, in order to achieve high compression ratios, one must change the internal contour of the compressor housing chamber to yield a larger initial starting volume and a correspondingly smaller discharge volume. With these changes being made, for a given pressure (volume) ratio, the location of the discharge port may be moved in the counterclockwise direction toward the inlet. This results in the discharge port subtending a longer angular arc denoted by $\theta m$ in FIG. 4 and thereby permits more efficient breathing of the compressor by allowing more time in the time period for a single revolution of the rotor for compressed gas to exit from the discharge port prior to the next trailing vane carried by the rotor passing the end of the discharge port in the clockwise direction.

Figure 4:
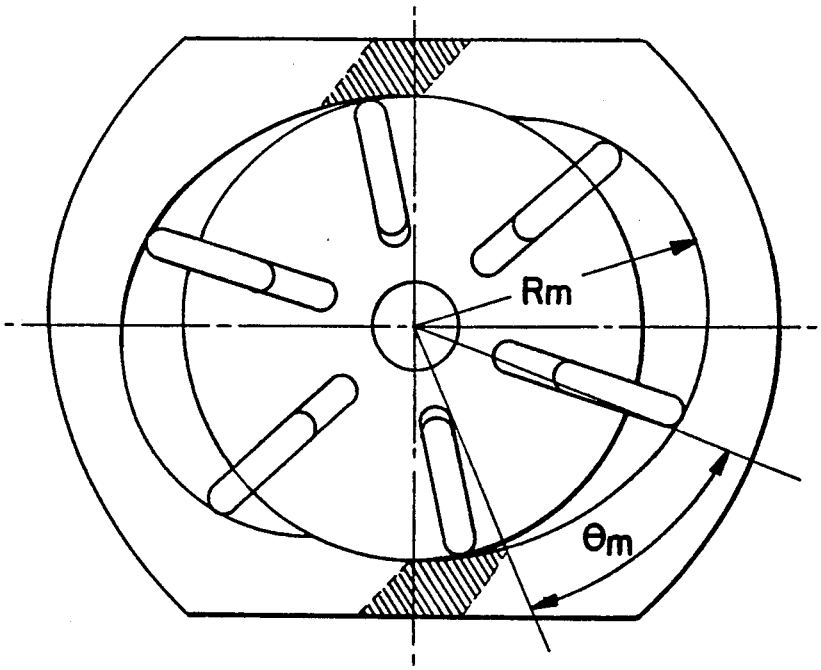
FIG. 4 shows a side view of a compressor made in accordance with the teachings of the present invention with a modified contour.

In keeping with this goal, Applicant has created a mathematical formula that uses a sine function to determine the radius of the chamber walls at each angular position thereof to accomplish the goals set forth above. A modified contour of the chamber is illustrated in FIG. 4 as will be described in greater detail below. Applicant's sine function is as follows:

$$Rm = Re + a^{*}(Re - Rr)(\sin 2\theta)^{n}$$

With reference back to FIG. 3, the internal chambers 65, 67 define an elliptical contour radius which is the radius Re in the formula. As also shown in FIG. 3, the rotor radius is Rr and, with reference to FIG. 4, the modified radius is shown as Rm.

With further reference to FIG. 3, the angle $\theta$ is measured from the right hand side of the major horizontal axis 64 with the angle $\theta$ being shown in FIG. 3. The combined value for "a" and $\sin 2\theta$ is positive for the upper half of the housing above the horizontal line 64 in FIG. 3 and the combined value of "a" and $\sin 2\theta$ is negative for the lower half of the housing 61 below the horizontal line 64.

In a further aspect, it is required that the value of Rm in any particular angular position $\theta$ along the housing 61 may never be larger than the major ellipse radius. The net result, as shown in FIG. 4, is that in the clockwise direction in the view of FIG. 4, the radius of the chamber rapidly rises to a radius equaling that of the ellipse major radius and continues in the clockwise direction and then rapidly decreasing below the horizontal axis as shown.

The power n as set forth in the sine function is set at greater than 1 but is generally not greater than 5. A typical value for the power n is usually 2 or 3. In this regard, particular reference is directed to FIGS. 5, 6 and 7. The methodology employed in developing the improved contour of the present invention uses an ellipse as the starting point for the internal contour of the housing. The prior art, as described above, employed an ellipse since an ellipse gives a larger displacement per revolution than a cylindrical housing internal contour and allows for a larger compression ratio within a smaller angular rotation from the inlet port to the discharge port. A sine function of twice the angle is used to modify the basic ellipse because this function has a value of 0 at $\theta$ equals 90° and at $\theta$ equals 0° resulting in recovering the ellipse minor and major radii. With reference to FIG. 3, $\theta$ equals 0° at the intersection of the horizontal line 64 and the right hand side of the housing 63. The location where $\theta$ equals 90° is located perpendicular thereto.

Turning, again, to the sine function, a nonzero value for this function in the first quadrant where $\theta$ is between 0° and 90° moves the maximum volume above the horizontal line 64 in the view of FIG. 3. Reversing the sign in front of this function in the fourth quadrant in the lower right hand side of FIG. 3 (when $\theta$ is between 0° and −90°) decreases the chamber volume in the fourth quadrant and allows for a larger pressure ratio at an earlier rotational angle to thereby allow more time for compressed gas to be discharged out the discharge port.

Figure 5:
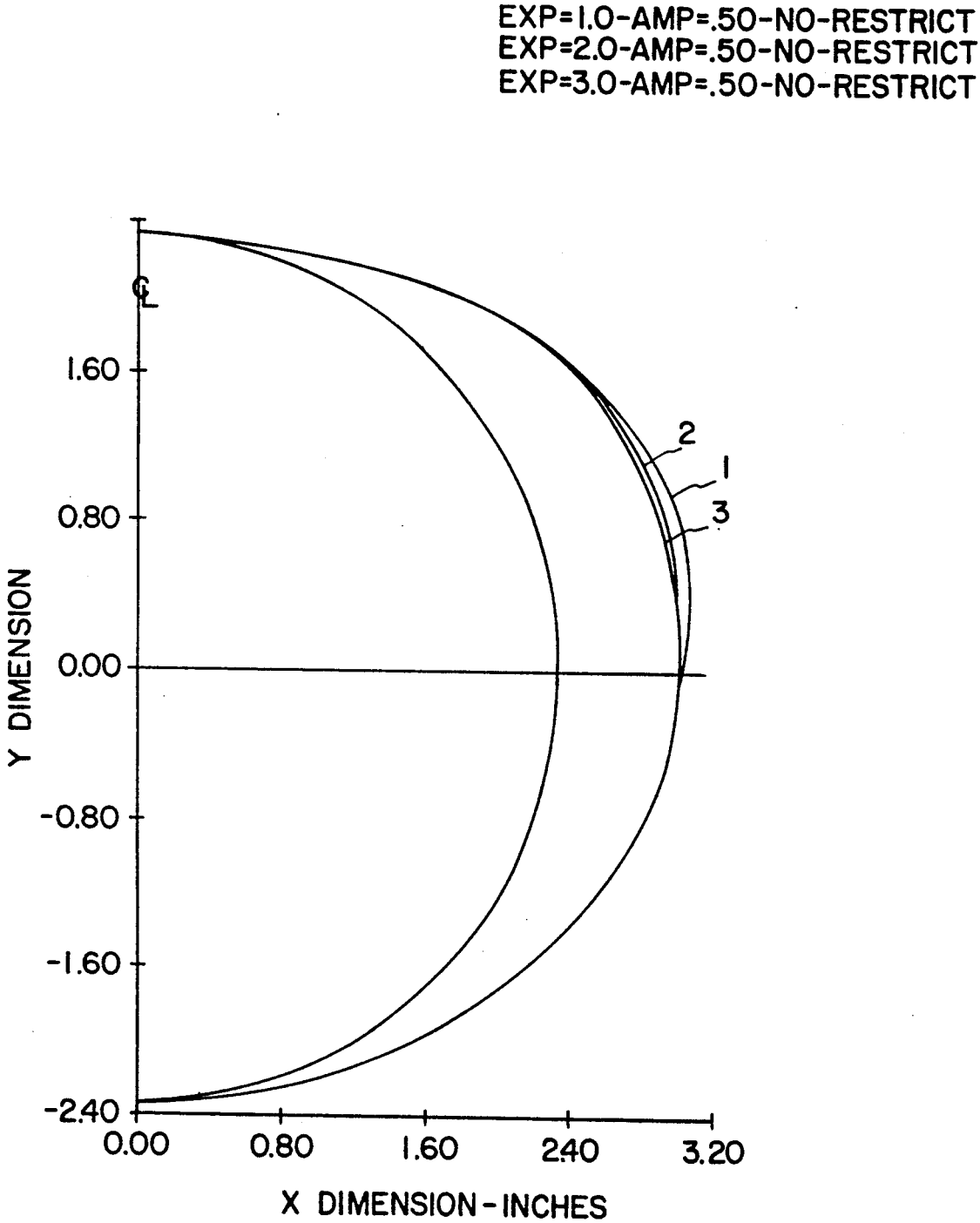
FIG. 5 shows a graph of the contour of the compressor illustrated in FIG. 4 showing variations in the contour shape through the use of differing exponents in the formula used to calculate the shape.

FIG. 5 shows an example of the effect of the exponent on the shape of the housing contour. As particularly shown in FIG. 5, the larger the value of the exponent n, the smaller the displacement from the vertical axis shown. The differing displacements for the differing values of the exponent n are shown in Table 1.

TABLE 1:

EFFECT OF EXPONENT ON DISPLACEMENT

| EXPONENT | AMPLITUDE | DISPLACEMENT FT**3/REV | INLET ANGLE | DISCHARGE ANGLE |
|---|---|---|---|---|
| 1 | .5 | 49.42 | 9.0 | −77 |
| 2 | .5 | 49.39 | 9.0 | −78 |
| 3 | .5 | 48.33 | 8.0 | −79 |
| 2 | 1.25 | 59.66 | 17.0 | −74 |

Figure 6:
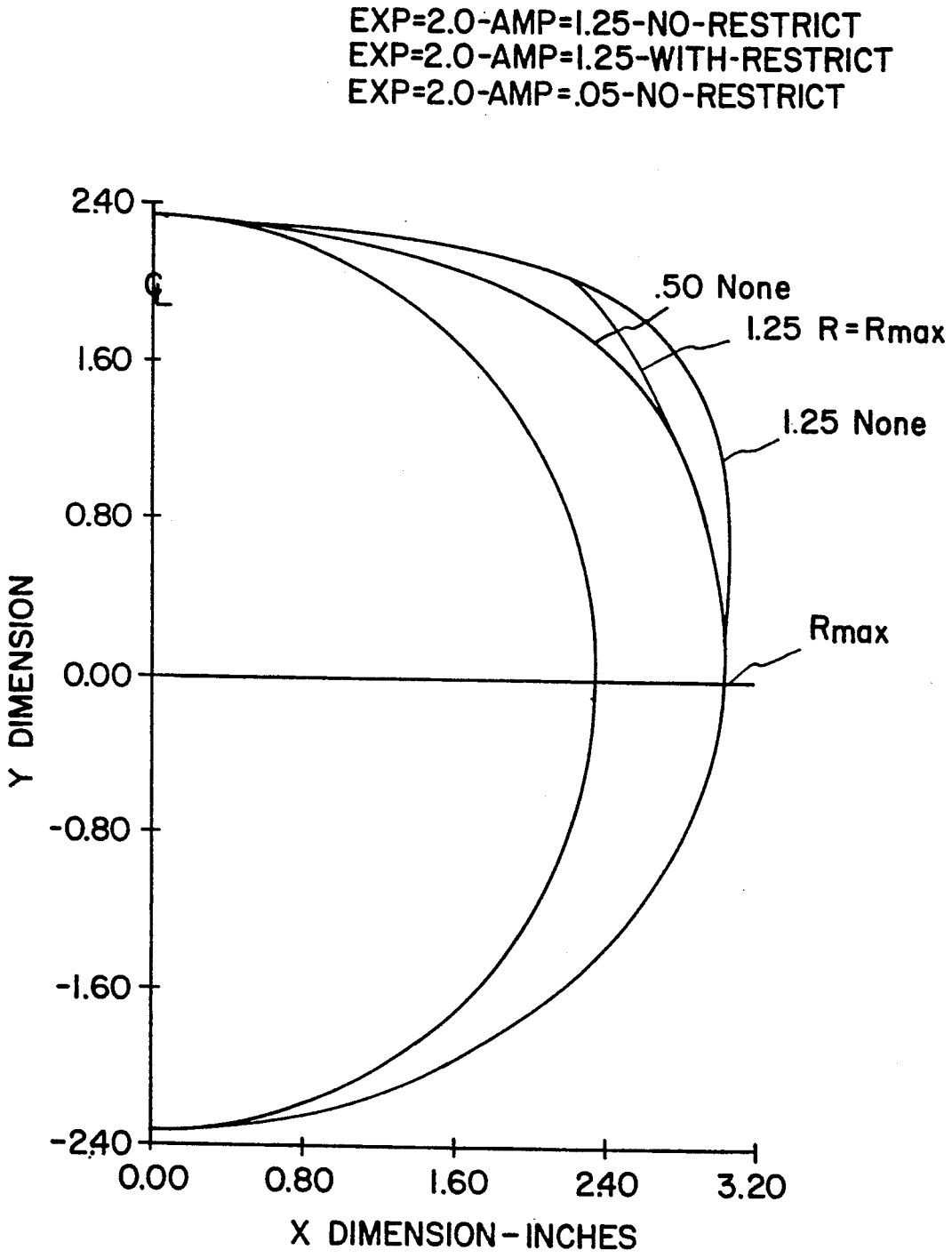
FIG. 6 shows a graph of the effect of varying the chamber amplitude dimension.
Figure 7:
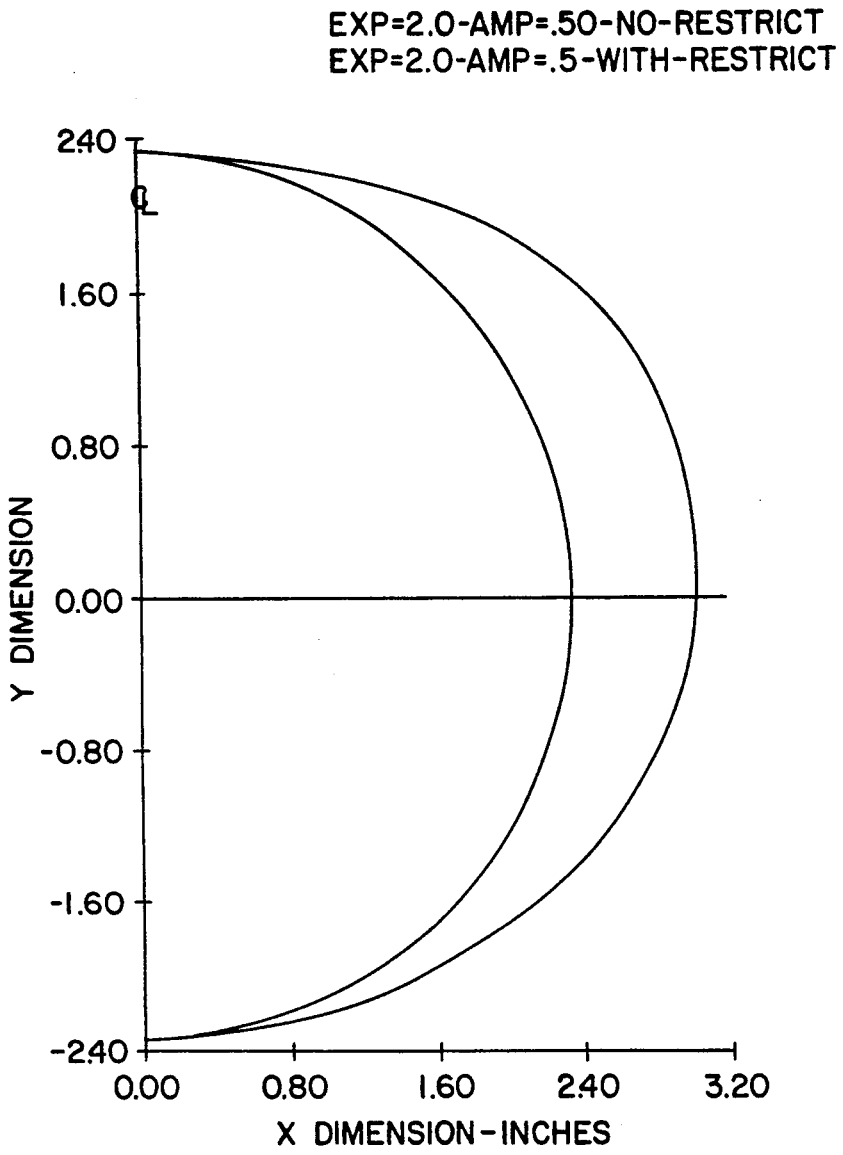
FIG. 7 shows a graph of the optimization of the chamber contour.

With reference to FIG. 6, an example of the effect of the amplitude "a" is shown. The larger the amplitude the larger the displacement. When the amplitude exceeds a value of one, the housing internal radius exceeds the major ellipse radius. Optimal design necessitates limiting the radius at any angular displacement to the maximum radius of the ellipse major radius or of a cylinder with radius Rmax where Rmax is the maximum elliptical radius. This is because allowing the radius to exceed the elliptical major radius can result in higher vane tip bending loads, higher friction losses and possible vane deflections as the vanes are extended from their respective slots further than they would extend were the shape to be maintained to, at most, the major elliptical radius. In an extreme case, a vane could extend to the point where it falls out of the rotor slot thereby damaging the housing, the chamber and the rotor. FIG. 6 shows three examples of exponents and the resulting shapes. One example includes an exponent of 2 and an amplitude of 0.5 with no restriction on the radius. A further example shows the exponent as 2 and the amplitude of 1.25 with no restriction on the radius. A third, an optimal example, shows the exponent at 2 with the amplitude at 0.5 with no restriction of the radius to the maximum radius were the shape to be an ellipse. FIG. 7 shows a contour which is formed through the use of the exponent 2, at an amplitude of 0.5 with and without restriction to the maximum outward shape of an ellipse. For amplitudes of 0.5, there is little effect of radial restriction or housing shape and the shapes are almost identical as shown in FIG. 7.

Figure 10:
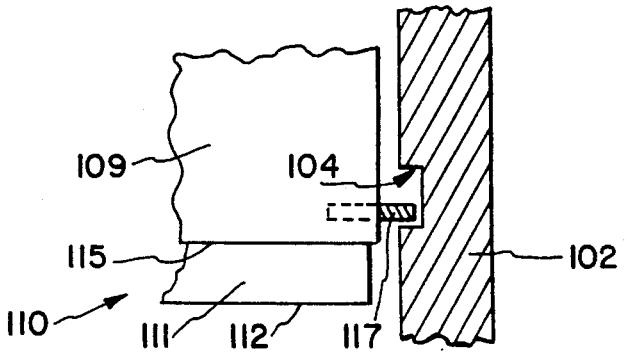
FIG. 10 shows a cross-sectional view along the line X—X of FIG. 9.
Figure 9:
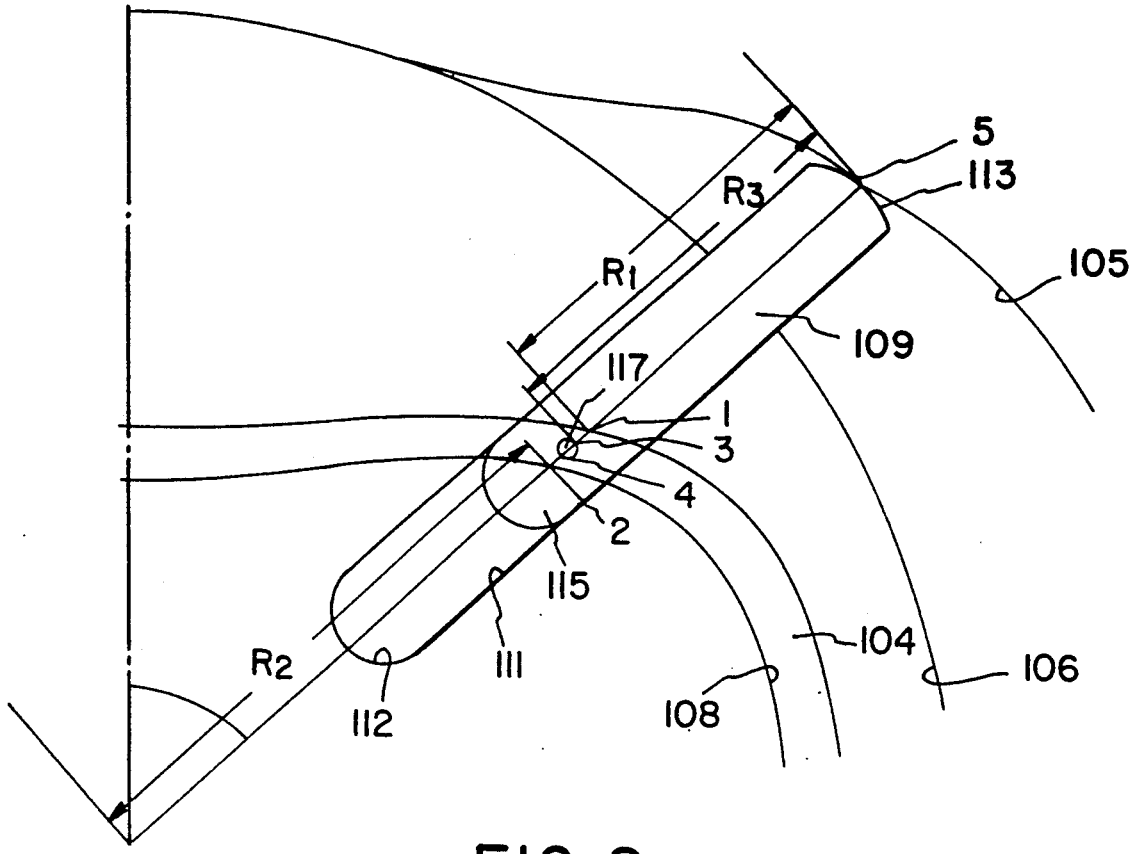
FIG. 9 shows a close-up view of one of the vanes illustrated in FIG. 8.
Figure 8:
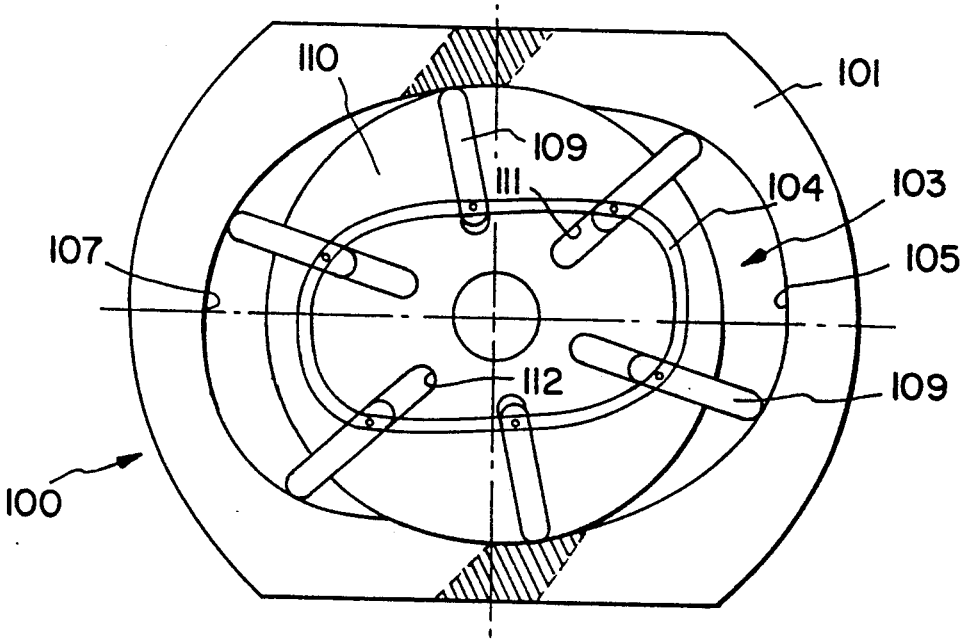
FIG. 8 shows a side view of a further aspect of the present invention, particularly details of a vane guide pin on each vane and a guide track to guide the vane guide pins.

With reference to FIGS. 8–10, a further feature of the present invention will now be described in detail. In particular, Applicant has devised a guide mechanism for the rotor vanes which allows them to reciprocate within a constrained range of distance to allow the vane tips to freely extend to an extent permitting engagement with the walls of the housing while preventing the vanes from falling inwardly beyond a desired degree.

With reference to FIGS. 8–10, a compressor 100 is seen to include a housing 101 having a internal chamber 103 divided into internal chambers 105 and 107. The internal chambers 105 and 107 have outer walls designed to be engaged by the vanes 109 as they reciprocate within respective slots 111. The walls of the internal chambers 105 and 107 are shaped in accordance with the teachings of the present invention through calculation using the sine function described above with a limit being placed on the radius at each position of angular displacement so that the radius never exceeds what the radius would be were the shape to be a perfect ellipse. Under such circumstances, optimization of the compression ratio and efficiency are achieved.

With particular reference to FIG. 9, the vane 109 is seen to include a tip 113 which is shown in engagement with the wall of the internal chamber 105, as well as an end 115 distal from the tip 113 and which is slidably received within the slot 111 within the rotor 110.

With reference to FIGS. 9 and 10, it is seen that the vane 109 carries a vane guide pin 117 which extends outwardly therefrom in perpendicular fashion (FIG. 10). The housing 101 includes a housing end cover 102 (FIG. 10) having an annular slot 104 machined therein. The slot 104 is schematically depicted in FIGS. 8 and 9. With reference to FIG. 9, the slot 104 has an outer extent 106 specifically designed to generally mimic the shape of the internal chamber walls 105 and 107. The outer extent 106 is a constant distance from the internal chamber walls 105 and 106 in a plane parallel thereto. The slot 104 also has an inner extent designated by the reference numeral 108 in FIG. 9 which inner extent 108 is spaced from the outer extent 106 in parallel fashion a sufficient distance to allow reciprocation of the vane 109 as it rotates within the chamber 103 as attached to the rotor 110. The inner extent 108 of the slot 104 is provided so that when the rotor 110 stops at any angular position, the vanes 109 will be prevented from falling into the slots 111 completely against the bottom surfaces 112 thereof. Without this feature whenever the rotor 110 is stopped, the vanes 109 would completely fall into the slots 111 until the surfaces 115 engaged the bottom portions 112 of the slots 111 (FIG. 10). Under such circumstances, when the rotor 110 would be restarted, a "slamming effect" would occur as the vanes are jolted outwardly through centrifugal force thereby causing the tips 113 of the vanes 109 to slam against the walls of the internal chambers 105 and 107 thereby creating potential for damage to the walls as well as to the vanes and thereby shortening the life of the compressor 100.

As particularly shown in FIG. 9, the distance R1 from the vane tip to the outer radius 106 of the track 104 is less than the distance from the vane guide pin 117 outer point 3 to the vane tip 5. This configuration results in the vane 109 always riding against the walls of the housing on the vane tip 113. Thus, the axle 117 does not ride on the outer extent wall 106 but, rather, rides in the configuration particularly shown in FIG. 9 within the track 104 but not engaging the walls 106 and 108.

When the compressor 100 is shut off, the vane 109 cannot fall into the bottom 112 of the slot 111. The distance from the vane tip 113 to the inner radius 108 of the vane track 104 is selected so that it is larger than the distance from the vane tip 113 to the point 4 on the vane guide pin 117 closest to the center of the rotor 110. This distance shown in FIG. 9 is the difference between R3 and R2 and is selected so that the vane tip 113 has a clearance of approximately, 0.05 to 0.15 inches from the housing wall 105 when the compressor is not operating and the vane guide pin 117 is resting on the inner surface 108 of the track 104 as exemplified by the point 2 in FIG. 9. This configuration reduces the start-up load on the vane tip and any possibility of permanent damage through forceful impingement of the vane tip 113 on the stator surface 105.

As such, an invention has been disclosed in terms of a preferred embodiment thereof which fulfills each and every one of the objects of the invention as set forth hereinabove and provides a new and improved high performance dual chamber rotary vane compressor of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A high performance rotary vane compressor, comprising:

a) a housing having two opposed chambers, each of said chambers being defined by an outer contour, each of said chambers having an inlet port and a discharge port;

b) a rotor rotatably disposed within said housing between said chambers, said rotor carrying at least four vanes, each vane having a tip and being reciprocably received within a slot formed in said rotor, whereby, rotation of said rotor causes said vanes to extend outwardly so that said vane tips engage said outer contours of said chambers;

c) each outer contour being defined by a mathematical formula including a sine function, said formula being used to define a contour radius of a said outer contour at each angular location therealong, said contour radius being limited to, at maximum, a major radius of an ellipse to restrict bending loads and deflections of said vanes, each said outer contour, in a direction of rotation of said rotor, rapidly increasing in radius from adjacent an inlet port thereof to an elliptical major radius to thereby increase displacement of each chamber over elliptical shape displacement;

d) said mathematical formula being as follows:

$$Rm = Re + a^* (Re - Rr) (\sin 2\theta)^n$$

where

Rm = Radius as modified

Re = elliptical radius a = +1 for an upper half of said housing and −1 for a lower half of said housing Rr = rotor radius n = an experimentally derived exponent $\theta$ = the particular angular displacement.

2. The compressor of claim 1, wherein each said outer contour, in said direction of rotation, rapidly decreases in radius immediately before a respective said discharge port whereby each chamber creates a larger compression ratio than would be the case with an elliptically shaped chamber.

3. The compressor of claim 1, wherein said exponent "n" is less than 5.

4. The compressor of claim 1, wherein said at least four vanes comprises six or eight vanes.

5. The compressor of claim 1, wherein each vane has a guide pin extending outwardly therefrom, said housing having a cover plate covering said chambers, said cover plate having a surface facing and enclosing said chambers, said surface having an endless groove sized to loosely receive each guide pin, said groove having a width allowing each vane tip to freely engage all of said outer contours, said width being designed to prevent each vane from engaging a bottom surface of each respective slot when said rotor is stopped.

6. The compressor of claim 5, wherein said at least four vanes comprises six or eight vanes.

7. The invention of claim 5, wherein said width has an outer extent which is a constant distance from said outer contour in a plane parallel thereto.

8. The invention of claim 7, wherein said width has an inner extent uniformly spaced from said outer extent and having a radius, at maximum, less than a minimum radius of said outer contour.

* * * * *